US007322130B2

(12) United States Patent
Seiter

(10) Patent No.: US 7,322,130 B2
(45) Date of Patent: Jan. 29, 2008

(54) INNER SOLE FOR A SHOE

(76) Inventor: Hans Seiter, Wilhelmsplatz 11, D-70182 Stuttgart (DE)

( * ) Notice: Subject to any disclaimer, the term of this patent is extended or adjusted under 35 U.S.C. 154(b) by 1004 days.

(21) Appl. No.: 09/423,619

(22) PCT Filed: May 8, 1998

(86) PCT No.: PCT/EP98/02706

§ 371 (c)(1),
(2), (4) Date: Nov. 15, 1999

(87) PCT Pub. No.: WO98/51178

PCT Pub. Date: Nov. 19, 1998

(65) Prior Publication Data

US 2001/0039746 A1 Nov. 15, 2001

(30) Foreign Application Priority Data

May 14, 1997 (DE) ..... 197 20 142
Jul. 30, 1997 (DE) ..... 197 32 786
Jan. 16, 1998 (DE) ..... 198 01 301

(51) Int. Cl.
*A43B 13/18* (2006.01)
*A43B 13/38* (2006.01)

(52) U.S. Cl. ..... 36/44; 36/43; 36/88; 36/71

(58) Field of Classification Search ..... 36/43, 36/44, 71, 88, 93, 28, 140, 141
See application file for complete search history.

(56) References Cited

U.S. PATENT DOCUMENTS 492,994 A * 3/1893 Sawyer ..... 36/43
1,093,608 A * 4/1914 Delaney ..... 36/43
1,730,466 A * 10/1929 Mallott ..... 36/140
1,841,942 A * 1/1932 Fenton ..... 36/44
1,867,431 A * 7/1932 Wood ..... 36/44
1,907,136 A * 5/1933 Weitsen ..... 36/43
1,960,418 A * 5/1934 Schaller ..... 36/43
2,404,731 A * 7/1946 Johnson ..... 36/44
2,423,622 A * 7/1947 Samblanet ..... 36/43
2,502,774 A * 4/1950 Alianiello ..... 36/44

(Continued)

FOREIGN PATENT DOCUMENTS

DE 3306425 A1 8/1984

(Continued)

*Primary Examiner*—Jila M Mohandesi
(74) *Attorney, Agent, or Firm*—Bacon & Thomas, PLLC

(57) ABSTRACT

The present invention relates to an inner sole for a shoe, comprising a base body, a covering layer and several cushioned layers arranged on the surface of the sole. A first cushioned layer is provided in the ball area of the forefoot, a second cushioned layer is included in the transition area of the metatarsus and the tarsus and a third cushioned area is provided between the metatarsus and the heel. The cushioned layers are subdivided into individual, separate plateau-like fields which are located close to each other in the transversal direction of the sole surface. This provides an inner sole which brings about a substantial improvement in the transport of fluids in the venous and lymphatic vessel system in the legs during movement of the foot joints and ankle joints by means of synergistic support of the muscle structure.

2 Claims, 6 Drawing Sheets

U.S. PATENT DOCUMENTS

| | | | | | |
|---|---|---|---|---|---|
| 2,734,287 | A | * | 2/1956 | Maccarone | 36/43 |
| 3,922,801 | A | * | 12/1975 | Zente | 36/44 |
| 4,020,570 | A | * | 5/1977 | Shames | 36/44 |
| 4,079,526 | A | * | 3/1978 | Fukuoka | 36/30 R |
| 4,408,402 | A | * | 10/1983 | Looney | 36/43 |
| 4,633,877 | A | | 1/1987 | Pendergast | |
| 4,694,831 | A | | 9/1987 | Seltzer | |
| 4,760,655 | A | * | 8/1988 | Mauch | 36/43 |
| 5,167,999 | A | * | 12/1992 | Wang | 36/43 |
| 5,179,792 | A | * | 1/1993 | Brantingham | 36/29 |
| 5,768,803 | A | * | 6/1998 | Levy | 36/43 |
| 5,787,608 | A | * | 8/1998 | Greenawalt | 36/11.5 |
| 5,864,969 | A | * | 2/1999 | Mauch | 36/141 |
| 6,000,147 | A | * | 12/1999 | Kellerman | 36/44 |

FOREIGN PATENT DOCUMENTS

| | | | |
|---|---|---|---|
| DE | G8431831 | | 2/1985 |
| DE | 3508582 | C2 | 2/1987 |
| DE | G8700681.2 | | 4/1987 |
| DE | G9002962.3 | | 6/1990 |
| DE | 9013727.2 | | 1/1991 |
| DE | 19603755 | A1 | 8/1997 |
| EP | 0316289 | A2 | 5/1989 |
| GB | 2289650 | | 11/1995 |
| WO | WO 94/23603 | | 10/1994 |

* cited by examiner

INNER SOLE FOR A SHOE

FIELD OF THE INVENTION

The present invention relates to an inner sole for a shoe, which is embodied as a foot support, having an inner sole with a sole base body, a sole cover layer and several cushion layers arranged on the surface of the sole.

BACKGROUND OF THE INVENTION

On the average, every fifth person in the age group between 20 and 70 years needs treatment because of diseased veins, and particularly every third person suffers from pathological vein changes which, although they do not yet need invasive treatment, nevertheless cause troubles and may need treatment in the future. In general, the cause of this often is a genetically caused weakness of the connective tissues, which leads to a relaxation of the walls of the veins and therefore to a lack in the ability of the venous valves to close. This results in a reduction of the venous return flow from the legs into the body.

Supportive measures are known in the form of so-called pressure hose, but preventive measures are unknown, in particular in connection with people who, because of their occupation, perform predominantly sitting or standing tasks. In these cases it is suggested to move the legs as much as possible in order to increase the venous return flow from the legs back into the body by promoting the so-called foot and calf muscle pump. This is aided to a great extent by walking barefoot, however, the shoes which are customary these days have a rather disadvantageous effect.

Walking shoes are known, wherein resilient layers in the form of supports are used in the heel area. But these known resilient layers are merely intended to compensate the specific overloads occurring during walking, or at least to assist in partially preventing them (German Patent DE 39 02 872 A1).

In connection with an orthopedic inner sole for shoes known from German Patent DE 87 00 681 U1, cushioned, layers are also embodied as an arched padding, which protrudes upward above the covering layer of the soles, and is provided in one piece with a large surface for support and pressure distribution in defined areas of the foot. An inner sole for a shoe is moreover known from German Patent DE 35 08 582 C2, which has a resilient padding in the area of the reflex zones of the foot. This padding has a symmetrically or asymmetrically concavely arched, or respectively bulged shape, and is essentially circular when viewed from above, and is therefore used for stimulating the nerves in these reflex zones. The reflex zones in the feet have an exclusive effect on the nervous system which, inter alia, affects the arterial blood supply of defined organs. No remedy for the problems of venous outflow of blood mentioned at the outset, in particular in the area of the lower leg, can be achieved by this.

An inner pole for a shoe is also known from U.S. Pat. No. 4,633,877, wherein an intermediate sole is put together from individual elements over its entire surface, of which a segment, which is arranged in the forefoot joint area, is divided into individual sub-segments. The sub-segments adjoin each other in the transverse direction of the sole surface. The individual segments and sub-segments are each flat and of the same thickness. By means of a differently resilient embodiment, this known inner sole for a shoe is used for the differentiated support of the foot, wherein the position of the segments takes into consideration the position of the corresponding bones of the foot.

A similar purpose is sought in European Patent, EP 0 316 289 A, wherein the inner sole of the shoe is provided with hollow spaces distributed over the sole surface, which can be filled with a resilient material corresponding to the shape of the foot. Such an inner sole for a shoe is used for orthopedic correction.

SUMMARY OF THE INVENTION

It is therefore an object of the present invention to provide an inner sole for a shoe of the type mentioned at the outset, which makes possible a considerable improvement of the venous return flow through the legs into the body, starting at the foot, by means of synergistic support of the muscle contraction in the course of the movement of the foot and ankle joints.

To attain this object, a first cushioned layer is provided in the forefoot joint area, a second cushioned layer in the metatarsus/tarsus transition area, and a third cushioned layer in the metatarsus/heel transition area. Each of these cushioned layers, which are provided for aiding the venous outflow of blood, is itself divided into individual plateau-like fields, which are positioned next to each other in the transverse direction of the sole surface and are separated from each other. The surface of the cushioned layers, which are also covered by the sole cover layer, approximately forms a plane with the surface of the sole base body are provided in connection with an inner sole for a shoe of the type mentioned.

Suitable support areas, which positively affect a contraction of the musculature of the foot, result from the steps in accordance with the present invention, wherein the cushioned layers are not raised separately, but are placed in a plateau-like manner into defined areas of the foot and are divided into fields which are separated from each other. These discrete support points are arranged in such a way that the muscle contraction is prompted, or respectively stimulated and therefore improved during the normal movement of the foot, but also considerably while standing. This results in a synergistic support during the movement sequence of the individual joints which, as a continuous homogeneous movement wave, has a positive effect on the venous and lymphatic vessel system. In other words, a homogeneous mechanical squeezing of the venous and lymphatic vessel system takes place, which leads to an increase in the venous return flow from the legs in the direction toward the body. This characteristic support movement promotes the action of the so-called foot and calf muscle pump, in particular since the division of the pillow-cushioned layers into individual areas is similar to the arrangement of the muscles in the foot.

With further embodiments in accordance with the present invention, cushioned layers are provided in further important areas of the muscle arrangement.

In accordance with one embodiment, the inner sole for a shoe can either be individually employed as an insole, or it is provided as a sole which is directly integrated into a shoe.

Further details of the present invention can be taken from the following description, in which the exemplary embodiments represented in the drawings are described in detail and explained.

DESCRIPTION OF THE PREFERRED EMBODIMENT

Figure 1:
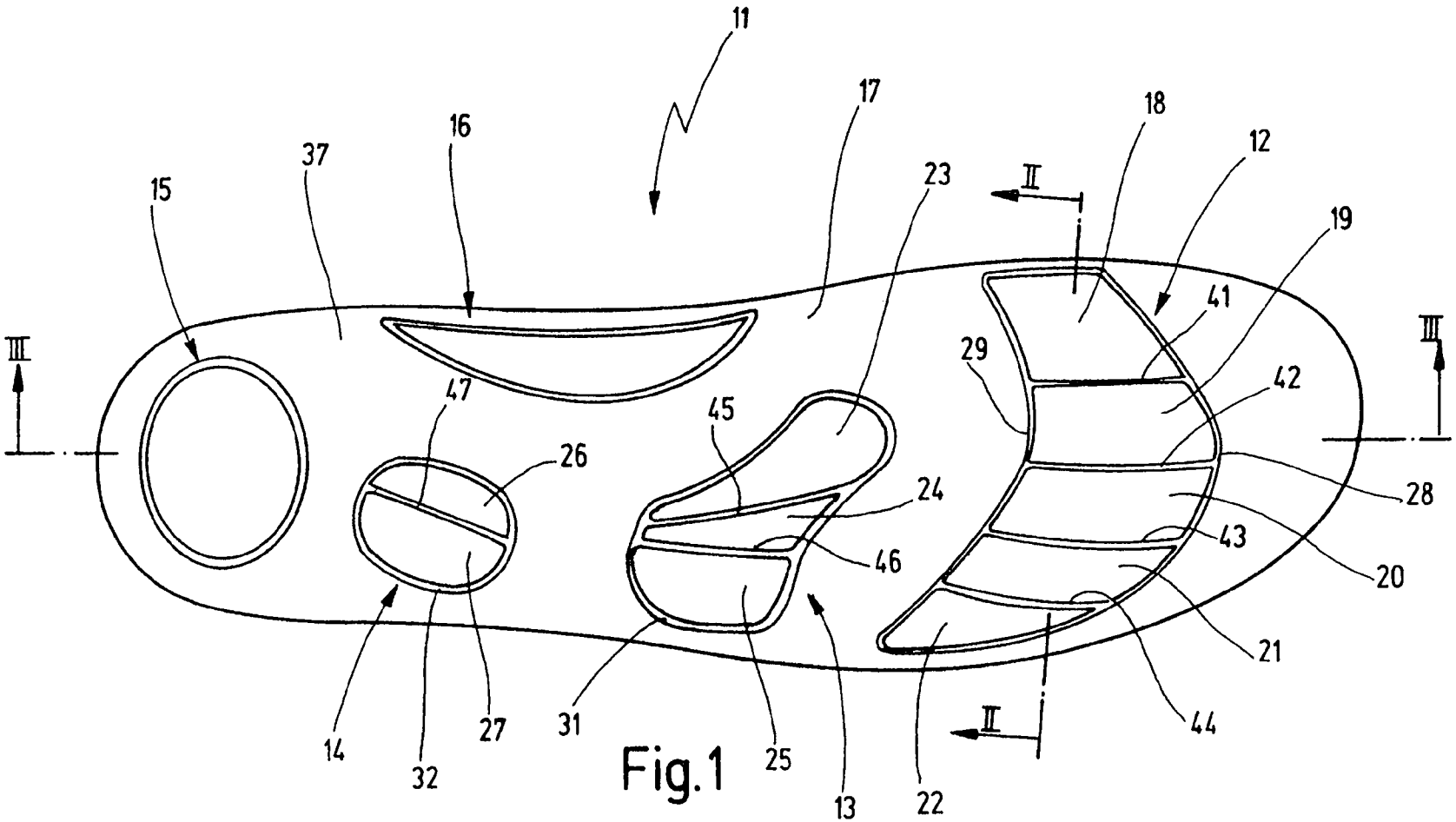
FIG. 1, is a view from above on an inner sole of a shoe in accordance with a first exemplary embodiment of the present invention.

The inner sole 11, or respectively 111, or respectively 111' represented in the drawings and embodied as a foot support, for example, in accordance with two exemplary embodiments and a variant of the second exemplary embodiment of the present invention, is used for the synergistic support of the musculature in the course of the movement of the foot and ankle joints for improving the conveyance of fluids in the venous and lymphatic vessel system through the legs, and it can be embodied as an insole or as a sole integrated into a shoe.

Figures 6, 7, 8:
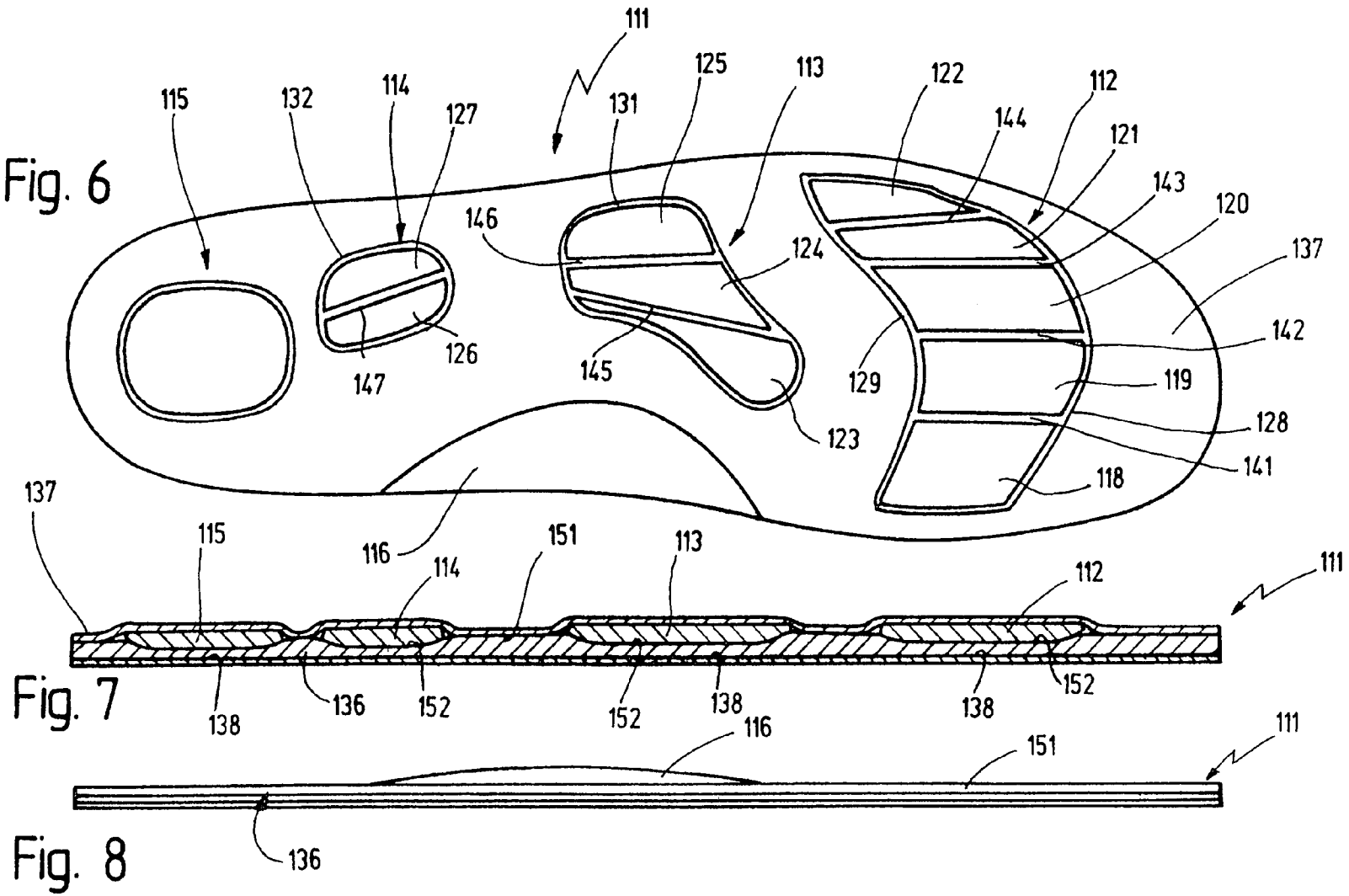
FIG. 6, is a view from above on an inner sole of a shoe in accordance with a second exemplary embodiment of the present invention.
FIG. 7, is a longitudinal section similar to the one in FIG. 3, but through the second exemplary embodiment.
FIG. 8, is an interior view in the longitudinal direction of the second exemplary embodiment.

As can be seen from FIGS. 1 and 6, the inner sole 11, or respectively 111 has several cushioned layers 12 to 16, or respectively 112 to 116 provided over the sole surface 17, or respectively 117, of which the cushioned layers 12, 112, 13, 113 and 14, 114 are divided into separate, plateau-like fields 18 to 22, 118 to 122, or respectively 23 to 25, or respectively 123 to 125, or respectively 26, 27, 126, 127, which are separated from each other.

The first cushioned layer 12, 112 is provided in the forefoot joint area, i.e. in the area of the toes. This first cushioned layer 12, 112 is divided into five fields 18 to 22, 118 to 122, which are separated from each other and arranged next to each other in the transverse direction of the inner sole 11, 111. The individual fields 18 to 22, 118 to 122 are of different width and length, approximately corresponding to the base area of the partial areas of the respective individual toes. This is correspondingly true for the shape of the front and rear borderline 28, 128, or respectively 29, 129, of this first cushioned layer 12, 112. The second cushioned layer 13, 113 is provided in the transition area between the metatarsus and the tarsus and in an area facing away from the plantar arch. This second cushioned layer 13, 113 is divided into three fields 23 to 25, 123 to 125, which are shaped to correspond to this partial area of the metatarsus/tarsus and are arranged divided and lying next to each other in the transverse direction of the inner sole 11, 111. This is correspondingly true for the circumferential borderline 31, 131 of this second cushioned layer 13, 113. The third cushioned layer 14, 114 is provided in a transition area between the metatarsus and the heel and divided into two fields 26, 126 and 27, 127 which, viewed in the transverse direction of the inner sole 11, 111, lie next to each other and are provided laterally on the outside. Here, too, the circumferential borderline 32, 132 approximately corresponds to the transition area between the metatarsus and the heel.

The fourth cushioned layer 15, or respectively 115, is arranged in the area of the heel and is designed in a plateau-like manner as a uniform, non-divided layer, which is approximately oval in the transverse, or respectively longitudinal direction of the inner sole 11, 111. The fifth cushioned layer 16, 116 is also embodied as a uniform, non-divided layer, but is provided in the approximate shape of a sickle in the area of the plantar arch.

The cushioned layers 12 to 16, 112 to 116 are made of a resilient (foam) material, for example silicon. They have a flat upper surface and are embodied to be approximately rectangular, advantageously slightly trapezoidal, in cross section.

Figure 2:
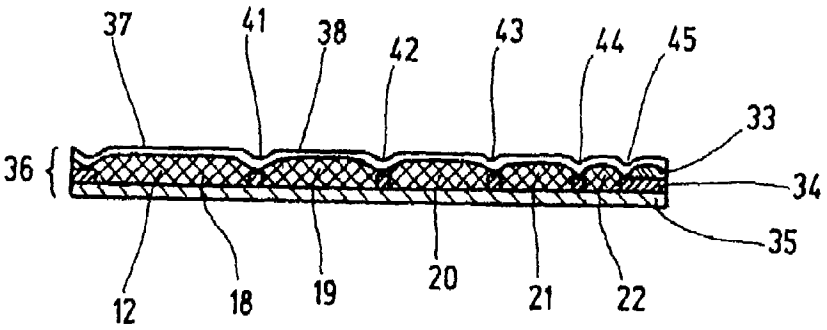
FIG. 2, is a section along the line II-II in FIG. 1 in an enlarged view.
Figure 3:
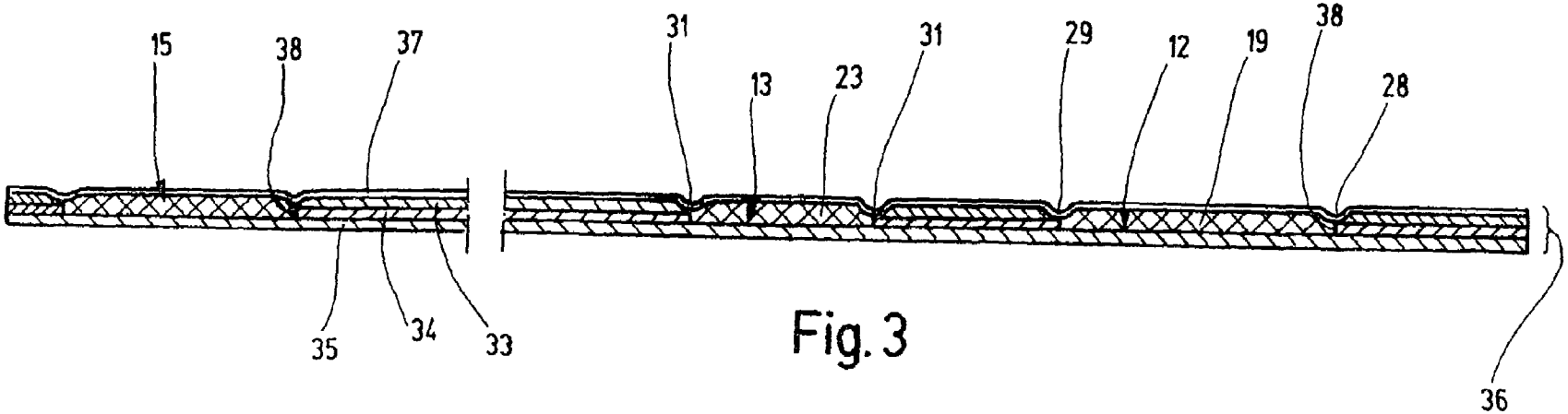
FIG. 3, is a section along the line III-III in FIG. 1 in an enlarged view.

In the first exemplary embodiment in accordance with FIGS. 1 to 3, the inner sole 11 has a sole base body 36, which here is triple-layered, and constitutes the basic shape of the inner sole 11 and in accordance with FIG. 1 is designed to correspond to a foot, here the right foot. It is understood that the corresponding other, i.e. left inner sole 11, is designed to be mirror-symmetrical. The sole base body 36 consists, for example, of three cork layers 33, 34, 35. A sole cover layer 37 which, for example is made of leather, is provided on the sole base body 36. The cushioned layers 12 to 16 are arranged in the sole base body 36 in a recessed manner between the sole base body 36 and the sole cover layer 37. The upper and center layers 33, 34 of the sole base body 36 are provided with corresponding depressions 38 for this purpose which, corresponding to the fields 18 to 27 of the cushioned layers 12 to 14 and corresponding to the cushioned layers 15, 16, have different base surfaces. The depressions 38 have been worked into the sole base body 36 to such a depth that the respective flat top of the plateau-like, cushioned layers 12 to 15 lies approximately in a plane, i.e. co-planar with the surface of the sole base body 36. The cushioned layer 16 constitutes an exception. With this exemplary embodiment the depressions 38 extend as far as the top of the lower layer 35. Among themselves, the cushioned layers 12 to 15 are of approximately the same height and are in a range between 2 to 5 mm, preferably in a range at 3 mm. The material of the top, or respectively the sole cover layer 37, covers the cushioned layers 12 to 16 in such a way, that they, or respectively their fields 18 to 27, are enclosed by a depression along the edge and are fixedly connected with, preferably glued to, the central layer 34 of the sole base body 36, so that, besides the borderlines 28, 29 and 31, 32, intermediate borderlines 41 to 47 result, which extend approximately vertically with respect to the transverse direction of the inner sole 11. In other words, the depressions 38 are designed to correspond to the total base surface of the cushioned layers 12 to 15.

Figure 4:
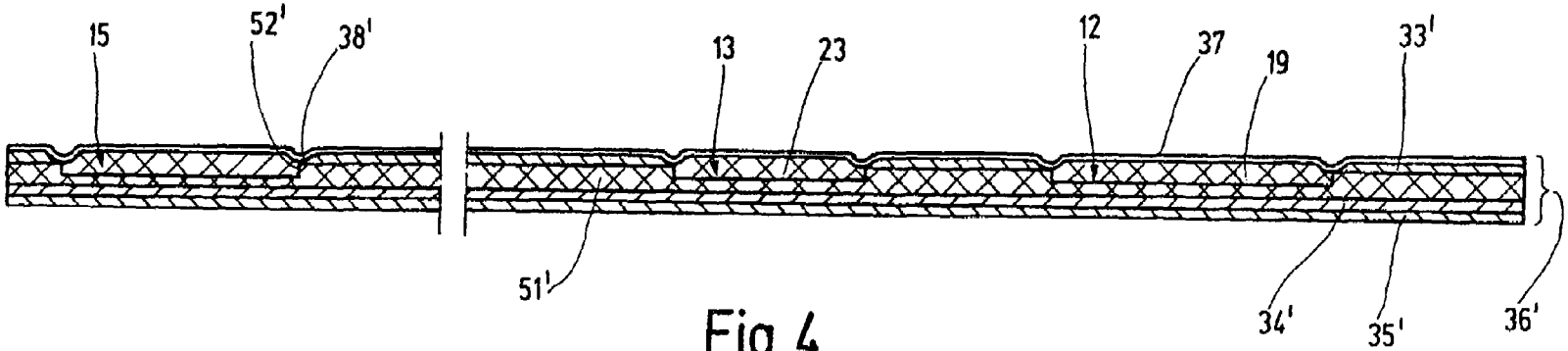
FIGS. 4 and 5, is are respectively a section similar to the one in FIG. 3, but in accordance with two variants of the first exemplary embodiment.
Figure 5:
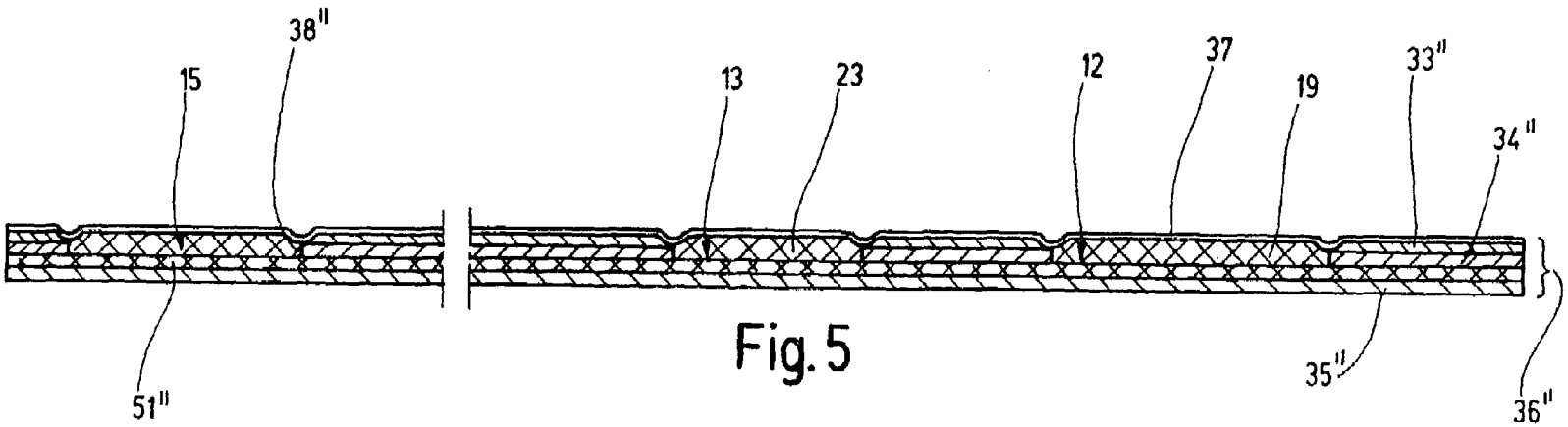

With the two variants in accordance with FIGS. 4 and 5, the surface arrangement of the cushioned layers 12 to 15 of the inner sole 11 of the shoe, including the arrangement of the fields 18 to 27, is exactly the same as shown in FIG. 1. The essential difference of the variants in FIGS. 4 and 5 with respect to the exemplary embodiment of FIGS. 2 and 3 rests in that a cushioned resilient intermediate layer 51', or respectively 51" is provided over the entire surface of the sole base body 36' between the sole base body 36', or respectively 36", and the sole cover layer 37', or respectively 37". Here, the intermediate layer 51 is made of the same resilient material as the cushioned layers 12 to 16 and is fixedly connected with, preferably glued to, the entire surface of one of the layers 34' (FIG. 4), or respectively 35" (FIG. 5), which have no depressions, of the sole base body 36'.

In accordance with FIG. 5, the cushioned intermediate layer 51" is of a thickness in the range between 2 to 3 mm, which is approximately uniform over the entire base surface, so that a continuous flat cushion results, which is considerably more resilient than the layers of the sole base body 36'. Compared with FIG. 3, in this variant of the intermediate layer 51" has been placed over the entire surface between the lower layer 35' and the center layer 34'.

In accordance with FIG. 4, the intermediate layer 51' lies between the center layer 34' and the upper layer 33' and has a different thickness. Accordingly, here the upper layer 33' is provided with depressions 38', and the cushioned intermediate layer 51' with depressions 52 corresponding to the depressions 38 for receiving the cushioned layers 12 to 16, over which the upper material, or respectively the sole cover layer 37' again extends in the same way as the sole cover layer 37 in accordance with FIGS. 2 and 3.

With the second exemplary embodiment in accordance with FIGS. 6 to 10, the inner sole 111 has a dual-layer sole base body 136, which constitutes the basic shape of the inner sole 111 and which in accordance with FIG. 6, or respectively 9, is designed to correspond to a foot, here the left foot. It is also understood here that the corresponding other, i.e. the right inner sole, is designed to be mirror-symmetrical. The sole base body 136 is constructed from two cork layers, for example. A sole cover layer 137 is provided on the sole base body, which is made of leather, for example.

Figure 9:
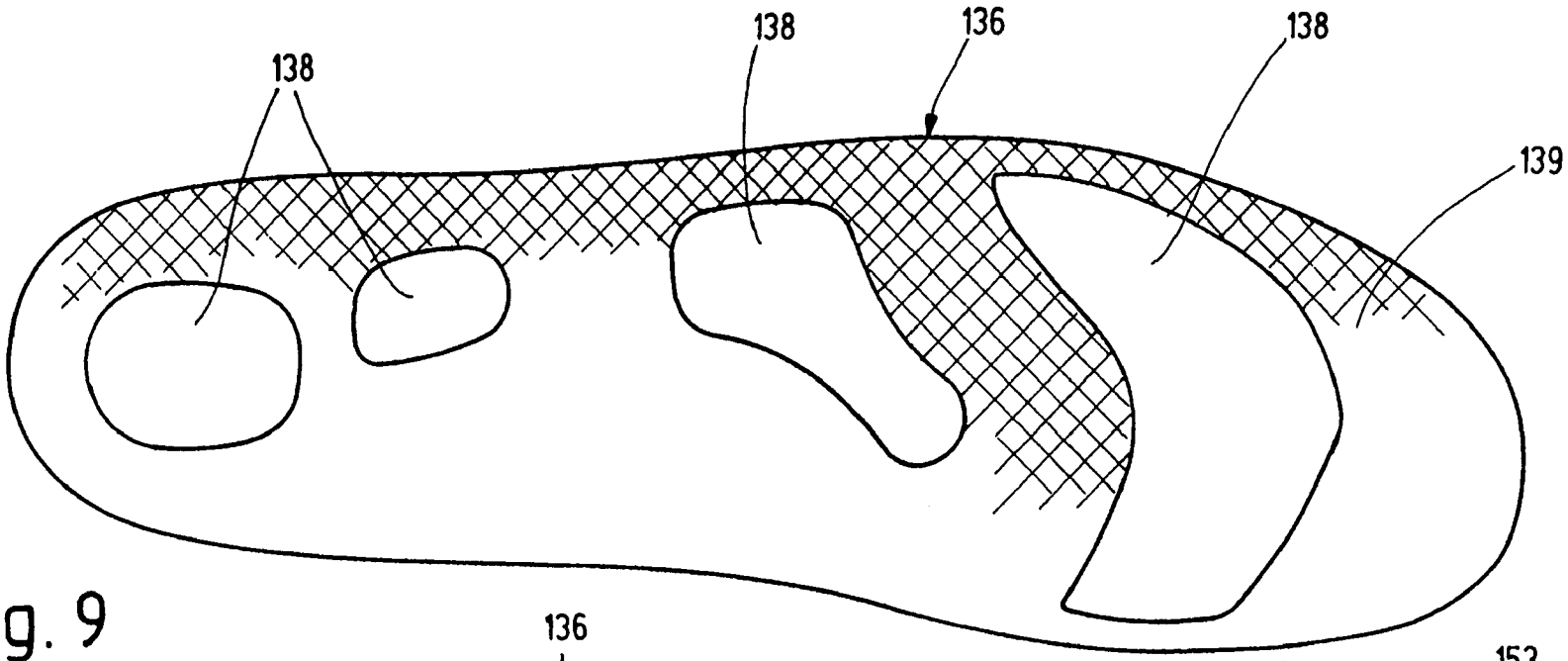
FIG. 9, is a view from above on the pre-processing stage of the inner sole of the shoe in accordance with the second exemplary embodiment of the present invention.
Figure 10:
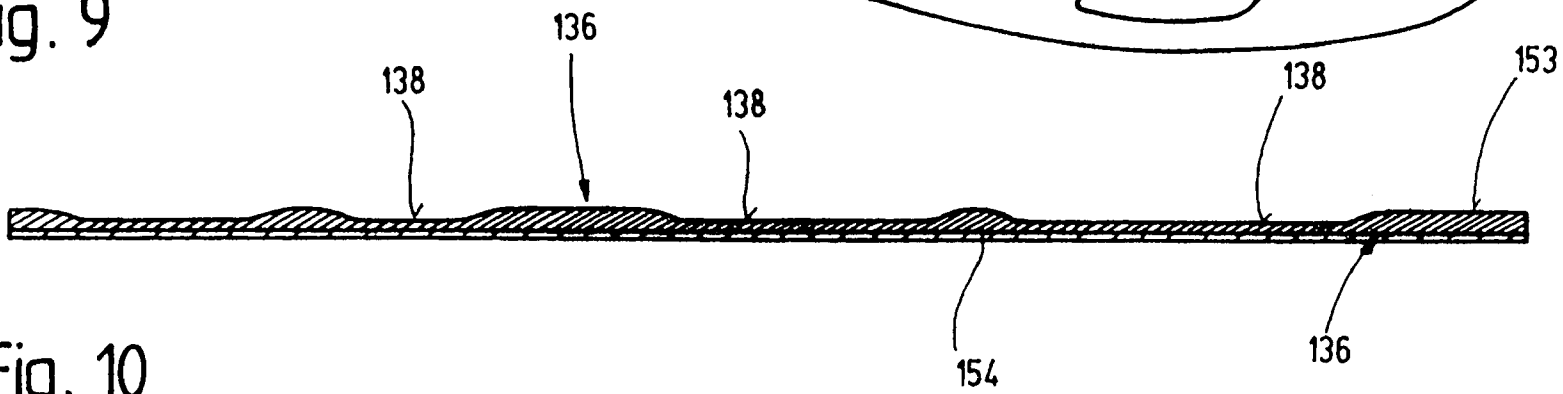
FIG. 10, is a longitudinal sectional view similar to the one in FIG. 7, but in the longitudinal direction of FIG. 9, FIG. 11, is a view from above on an inner sole of a shoe in accordance with a variant of the second exemplary embodiment of the present invention.

The cushioned layers 112 to 115 are arranged between the sole base body 136 and the sole cover layer 137 in a recessed manner. The sole base body 136 is provided with corresponding depressions 138 for this purpose which, corresponding to the fields 118 to 127 of the cushioned layers 112 to 114 and corresponding to the cushioned layer 115, have a different base surface. FIGS. 9 and 10 show the corresponding depressions 138 in a view from above, or respectively in section. Thus, the sole base body 136 has a maximum thickness in the range between 3.5 to 4 mm, preferably 3.7 mm, and a minimum thickness in the area of its depressions 138 between approximately 1 mm and 1.5 mm, preferably 1.3 mm. It is furthermore indicated in FIG. 9 that the entire surface 136 of the sole base body 153, which for example is multi-layered, is covered with a thin textile cover 139. It is possible in a manner not shown that, instead of or in addition to this, the underside 154 of the sole base body 136 can be covered over its entire length with such a thin textile cover. The sole base body 136, or respectively its layers, are made of cork scrap compacted by means of a binder.

In accordance with FIG. 7, the entire surface 152 of the sole base body 136 is moreover covered with a resilient, or respectively cushioned intermediate layer 151. The intermediate layer 151 thus covers the entire surface, including the depressions 138 of the sole base body 136, so that depressions 152 corresponding to the depressions 138 remain in the intermediate layer 151. The intermediate layer 151 has a continuous thickness of, for example, approximately 3 mm. The same as the cushioned layers 112 to 116, the intermediate layer 151 is preferably made of a foamed material, for example foamed natural latex.

The cushioned layers 112 to 115 have been placed into the depressions 152 of the intermediate layer 151 and consist, for example, of the foamed natural latex and have a thickness in the range between 4 and 5 mm, preferably of 4.5 mm, for example. In contrast thereto, the cushioned layer 116 for the plantar arch of the foot is not arranged in a depression, but directly on the intermediate layer 151, which in this area is flat, i.e. not provided with depressions. On its thickest part, this cushioned layer 116 also has a thickness of approximately 4 to 5 mm, preferably 4.5 mm, wherein its thickness continuously decreases toward the inside of the sole 111. Thus, the flat surfaces 156 of the plateau-like, cushioned layers 112 to 115 are raised by 1.5 to 2.5 mm, preferably approximately 2 mm, above the surface 157 of the intermediate layer 151. The material on the top, or respectively the sole cover layer 137, covers the cushioned layer 116 and furthermore the cushioned layers 112 to 115 in such a way that the latter, or respectively their fields 118 to 127, are enclosed by a depression along the edge and are fixedly connected with, preferably glued to, the intermediate layer 151 so that, besides the borderlines 128, 129 and 131, 132, intermediate borderlines, or respectively areas 141 to 147, result, which extend approximately vertically with respect to the transverse direction of the inner sole 111.

Figure 11:
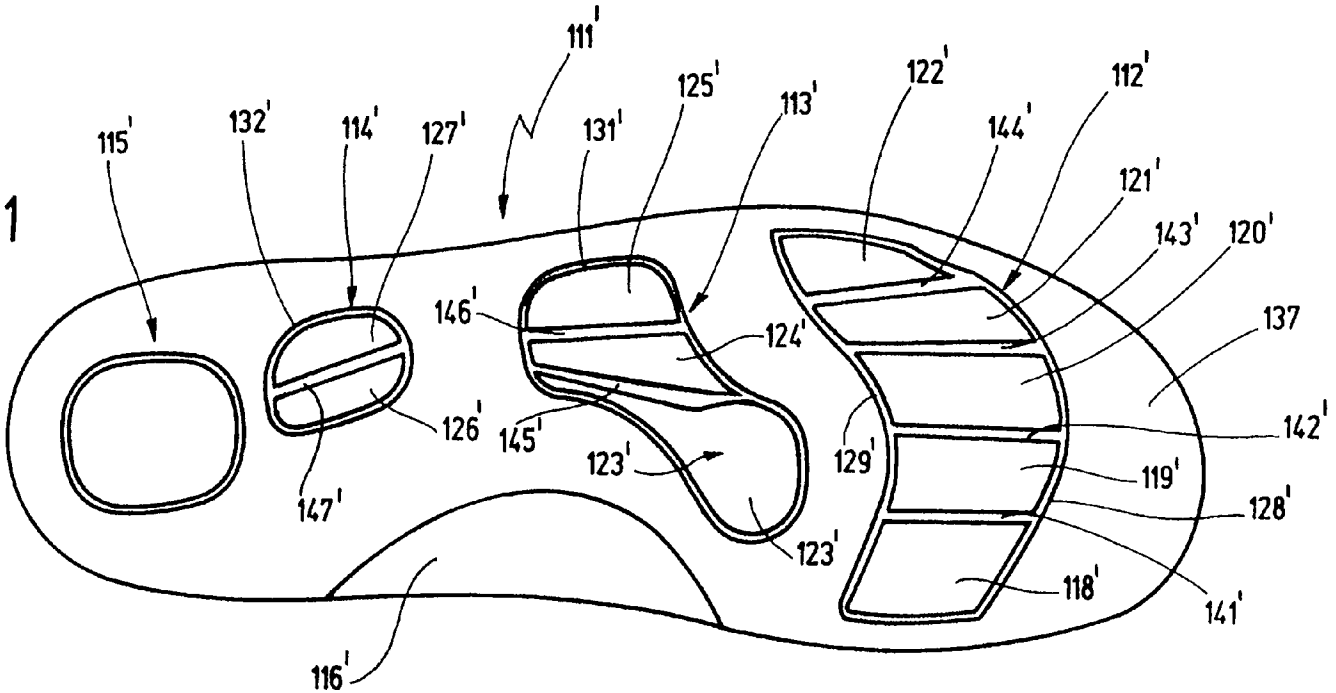
Figure 12:
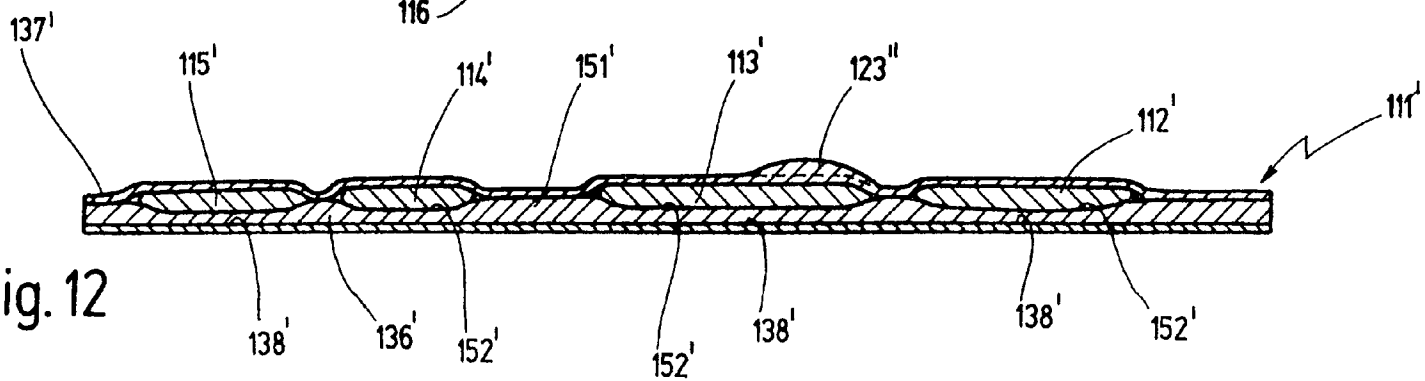
FIG. 12, is a longitudinal section similar to the one in FIG. 7, but through the variation of the second exemplary embodiment.

The variant represented in FIGS. 11 and 12 differs from the second exemplary embodiment only in the design of the second cushioned layer 113'. FIGS. 11 and 12 for this variant have the same reference numerals as those in FIGS. 6 to 10, only a prime has been added.

In accordance with FIGS. 11 and 12, the second cushioned layer 113' is provided with the outer field 125', the center field 124' and the inner field 123', wherein the two former fields are designed in accordance with the representations in FIGS. 6 and 7. In comparison with the field 123 in FIG. 6, the inner field 123' of the second cushioned layer 113' has been pulled forward in a bow shape toward the first cushioned layer 112'. This bow-shaped extended area 123' lengthens and widens the front surface of the field 123'. As can be seen in FIG. 12, this bow-shaped extended area 123' is not level like the remaining surface areas of the cushioned layer 113', but is arched upward, i.e. again raised in relation to the raised surface of the sole cover layer 137'. This arching raises the level of the bow-shaped extended area 123' in relation to the remaining area of the field 123' and the fields 124' and 125' by approximately 2 mm.

The invention claimed is:

1. The inner sole of a shoe, comprising:

a sole base body, defining a sole surface and having a forefoot joint area, a metatarsus/tarsus area, a metatarsus/heel transition area, a heel area, and a plantar arch area;

a sole cover layer;

a first cushioned layer provided in said forefoot joint area;

a second cushioned layer provided in said metatarsus/tarsus transition area; a third cushioned layer provided in said metatarsus/heel transition area, a fourth cushioned layer provided in said heel area, said fourth cushioned area defining a surface which is plateau-shaped and is raised with respect to said sole surface; and a fifth cushioned layer provided in said plantar arch area, said fifth cushioned layer being in the shape of a sickle, wherein:

said first, second and third cushioned layers are located at support areas of said sole base body which positively affect a contraction of the musculature of the foot, serving thereby to aid the venous outflow of blood;

said first, second and third cushioned layers are each divided into individual plateau-like fields, separated from but positioned next to each other in the transverse direction of said sole surface;

each cushioned layer defines a surface, which are each raised with respect to said sole surface;

said sole cover layer covering said surface of each cushioned layer and said sole surface; and each cushioned layer is recessed in said sole base body.

2. The inner sole as defined in claim 1, wherein: said fourth and fifth cushioned layers are located at support areas of said sole base body which positively affect a contraction of the musculature of the foot, serving thereby to aid the venous outflow of blood.

* * * * *